US005207603A

United States Patent [19]

Peloza

[11] Patent Number: 5,207,603

[45] Date of Patent: May 4, 1993

[54] DUAL THICKNESS BLADE TYPE ELECTRICAL TERMINAL

[75] Inventor: Kirk B. Peloza, Wheaton, Ill.

[73] Assignee: Molex Incorporated, Lisle, Ill.

[21] Appl. No.: 892,087

[22] Filed: Jun. 2, 1992

[51] Int. Cl.[5] ..... H01R 13/02

[52] U.S. Cl. ..... 439/884; 439/872; 439/882

[58] Field of Search ..... 439/824, 825, 866, 871, 439/872, 877, 882, 884, 891, 924

[56] References Cited

U.S. PATENT DOCUMENTS

| | | | |
|---|---|---|---|
| 3,182,282 | 5/1965 | Turner | 439/882 |
| 3,238,497 | 3/1966 | Zell et al. | 439/825 |
| 4,390,231 | 6/1983 | Plyler et al. | 439/872 |
| 4,979,915 | 12/1990 | Pitts | 439/884 |
| 4,992,064 | 2/1991 | Steinhardt et al. | 439/845 |
| 5,083,944 | 1/1992 | Pitts | 439/595 |

FOREIGN PATENT DOCUMENTS 0340951 4/1989 European Pat. Off. ..... 13/434

*Primary Examiner*—Paula A. Bradley
*Attorney, Agent, or Firm*—Stephen Z. Weiss

[57] ABSTRACT

A stamped and formed metal electrical terminal includes a male contact blade at one end for being received in a complementary female contact member. A conductor terminating portion is provided at an opposite end of the terminal, and an intermediate section joins the male contact blade and the conductor terminating portion. The male contact blade includes a pair of juxtaposed flat blade portions each being interconnected directly to the intermediate section by a respective connecting wall to establish direct electrical continuity between the blade portions and the intermediate section. At least one tab extends from an edge of at least one of the flat blade portions, and the tab is bent over the opposite side of the other flat blade portion to prevent the blade portions from separating.

17 Claims, 3 Drawing Sheets

DUAL THICKNESS BLADE TYPE ELECTRICAL TERMINAL

FIELD OF THE INVENTION

This invention generally relates to the art of electrical connectors and, particularly, to a stamped and formed metal electrical terminal of the blade type wherein the blade is provided with a double thickness.

BACKGROUND OF THE INVENTION

Electrical connectors, specifically mateable and unmateable electrical connectors, have been used for years with male and female or pin and socket terminals which interengage when the connectors are mated. The terminals are mounted in dielectric housings and the housings usually contain a plurality of such interconnectable terminals. A specific type of the more general pin and socket electrical terminal design is commonly termed a blade contact arrangement mateable with a receptacle or female contact element. The blade contact simply is formed of an elongated flat blade portion at one end of the terminal, the blade contact being joined to a conductor terminating end by an intermediate section.

Most blade contact and receptacle contact terminals are fabricated of stamped and formed metal material. Therefore, a given blade contact has a given thickness determined by the practical aspects of stamping and forming the components from sheets of metal.

Heretofore, there has been a problem with providing sufficient rigidity for a blade contact of a terminal. If the sheets of metal are provided of a sufficient thickness to provide sufficient rigidity for the blade contact, forming the remainder of the terminal is made more difficult, requiring unnecessarily bulky and rigid stamping and forming dies, and the cost of such material is unnecessarily excessive. In addition, uniform electrical specifications are requiring the blade contacts to be of a thickness which is beyond that which is desirable for fabrication from a single-thickness sheet of metal material. Consequently, blade contacts have been fabricated to have a dual thickness of the sheet metal material to provide sufficient rigidity and to satisfy the electrical specifications.

Heretofore, the most common type of dual thickness blade contact has been fabricated by folding the sheet metal material along an elongated edge of the blade contact. In other words, one or both sides of the blade are folded 180° about a line parallel to the longitudinal axis of the terminal. Such configurations not only are difficult to manufacture, but they may result in stress fractures in the long fold line. In addition, by folding the blade along an elongated edge thereof, electrical current discontinuity results longitudinally of the terminal from at least one of the blade thicknesses to the intermediate section of the terminal. This results in a poor flow of electricity because of such discontinuity. Efforts have been made to provide separately formed connecting portions, such as including serrated teeth, for establishing continuity between the intermediate section of the terminal and the folded-over thickness of the blade contact. This latter approach adds considerably to the costs forming steps required to fabricate the terminal.

This invention is directed to solving these problems and satisfying the need of providing a simple, yet electrically effective dual thickness blade contact for a stamped and formed metal terminal.

SUMMARY OF THE INVENTION

An object, therefore, of the invention is to provide a new and improved stamped and formed metal electrical terminal of the character described, having a dual thickness blade contact portion.

Generally, in the exemplary embodiment of the invention, the terminal includes a male contact blade at one end for being received in a complementary female contact member, a conductor terminating portion at an opposite end, and an intermediate section between the male contact blade and the conductor terminating portion. The invention contemplates that the male contact blade include a pair of juxtaposed flat blade portions each being interconnected directly to the intermediate section by a respective connecting wall in order to establish electrical continuity therewith.

The invention also contemplates that at least one tab be stamped to project and extend from an edge of at least one of the flat blade portions, the tab being bent over the other flat blade portion and crimped thereto to prevent the blade portions from separating. In the preferred embodiment of the invention, both blade portions include notches in an edge thereof. The tab extends from within the notch of the one blade portion and is bent into the notch of the other blade portion. The notches are of respective depths at least equal to the thickness of the tab so that the tab does not project beyond the edges of the blade portion. In addition, the notches are only slightly wider than the tab, longitudinally of the terminal, to prevent the blade portions from sliding relative to each other.

Before crimping the aforesaid tab, the blades are mutually bowed outwardly from each other to prestress the blades.

Another feature of the invention involves the provision of elongated reinforcing ribs stamped from the terminal and spanning a juncture between each flat blade portion and its respective connecting wall.

A further feature of the invention involves providing the blade portions of different lengths so that a distal end of one blade portion extends beyond a distal end of the other blade portion. Therefore, the distal ends are sequentially received in the complementary female contact member to reduce the insertion force of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
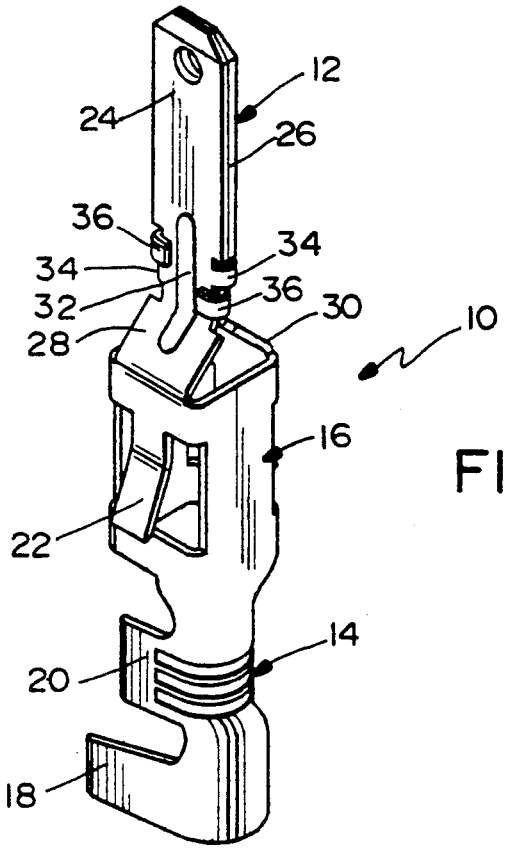
FIG. 1 is a perspective view of a blade-type electrical terminal incorporating the concepts of the invention.

Referring to the drawings in greater detail and, first to FIGS. 1-4A, the invention is embodied in a stamped and formed metal electrical terminal, generally designated 10, which includes a male contact blade, generally designated 12, at one end for being received in a complementary contact member, as described hereinafter. The terminal includes a conductor terminating portion, generally designated 14, at its opposite end, and an intermediate section, generally designated 16, between male contact blade 12 and conductor terminating portion 14.

Conductor terminating portion 14 includes two pairs of crimp arms 18 and 20, respectively. As will be seen hereinafter, one pair of crimp arms 18 are provided for crimping onto the insulation of an electrical cable, and the other pair of crimp arms 20 are provided for crimping onto the conductor(s) of the cable.

Intermediate section 16 is generally box-shaped for insertion into a generally rectangular through passage in a connector housing, as described hereinafter. A pair of spring locking tangs 22 project outwardly from intermediate section 16 for locking the terminal in the connector housing, again as described in greater detail.

Male contact blade 12 includes a pair of juxtaposed flat blade portions 24 and 26 to provide a dual thickness for the male contact blade. The dual thickness of the stamped and formed male contact blade adds rigidity to the blade and satisfies certain electrical specifications.

Good electrical continuity is provided between male contact blade 12 and intermediate section 16 of terminal 10 by providing connecting walls 28 and 30 which directly interconnect flat blade portions 24 and 26, respectively, to the intermediate section. Elongated, raised reinforcing ribs 32 are stamped from the sheet metal material of the terminal and span the juncture between each flat blade portion 24 and 26 and its connecting wall 28 and 30, respectively.

The invention contemplates the provision of tab means at the edges of flat blade portions 24 and 26 to hold the flat blade portions in close juxtaposition with each other and to prevent the blade portions from sliding longitudinally relative to each other. More particularly, flat blade portion 24 has a pair of tabs 34 projecting from opposite edges thereof. The tabs are bent over and crimped against the opposite side of flat blade portion 26. Likewise, flat blade portion 26 has a pair of tabs 36 bent over and crimped against the opposite side of flat blade portion 24.

Figure 2A:
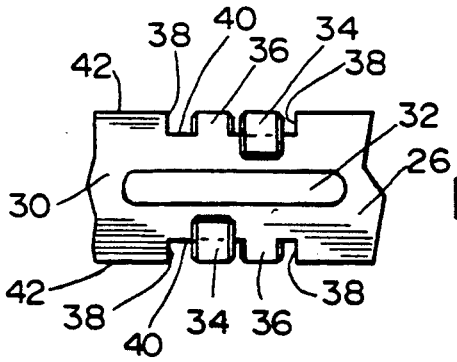
FIG. 2A is a fragmented side elevational view of the tab area of the terminal, opposite the side that shown in FIG. 2, in the area of the bent tabs of the contact blade.
Figure 2:
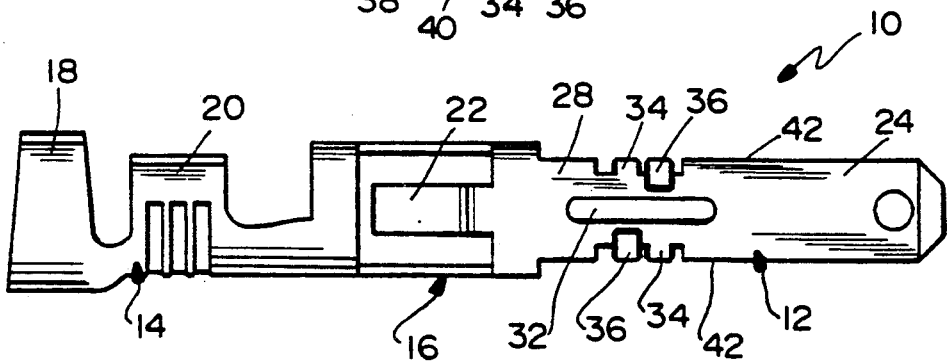
FIG. 2 is a side elevational view of the terminal.

In fabrication, all four tabs 34 and 36 are crimped tightly against the respective opposite sides of the opposite flat blade portions to hold the pair of blade portions tightly against each other in juxtaposition as shown in FIGS. 1-4A. In addition, as seen particularly in FIGS. 2 and 2A, each flat blade portion 24 and 26 has a notch in each of its longitudinal edges and from which its respective tabs extend for bending over the opposite side of the opposite blade portion. In other words, as seen in FIG. 2A, each notch 38 has its own base or edge 40 from which the tabs project. It can be seen that the depths of notches 38 are such as to be at least equal to the thickness of the sheet metal material of the terminal, particularly the thickness of tabs 34 and 36. Therefore, when the tabs are bent over the opposite sides of the opposite flat blade portion, the tabs do not project beyond the longitudinal edges 42 of the blade portions. Consequently, the tabs will not become snagged on any extraneous objects or to score or otherwise interfere with insertion of the male contact blade 22 in its respective housing or while mating with a complementary female contact element.

Still further, although the dimensions may be somewhat exaggerated in the drawings, notches 38 are only slightly wider (i.e. in the longitudinal direction of male contact blade 12) than the area occupied by tabs 34 and 36. Consequently, the ends of the notches define stops against which the tabs will engage to prevent blade portions 24 and 26 from sliding relative to each other in a longitudinal direction.

Figure 5:
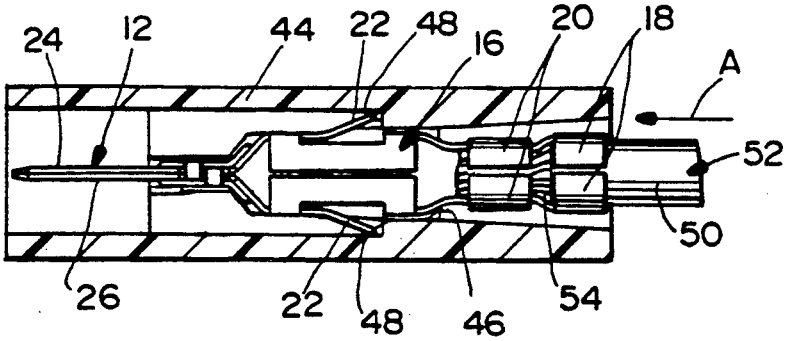
FIG. 5 is a longitudinal section through an electrical connector housing mounting the electrical terminal of the invention, the terminal being crimped to an electrical cable.

FIG. 5 shows stamped and formed electrical terminal 10 mounted within a dielectric connector housing, generally designated 44. It can be seen that the box-shaped intermediate section 16 of the terminal is positioned within a complementarily shaped through passage portion 46 in the housing. The terminal is inserted into the housing in the direction of arrow "A" until spring locking tangs 22 snap behind locking shoulders 48 within the housing to prevent the terminal from backing out of the position shown. Lastly, it can be seen that the one pair of crimp arms 18 are crimped onto the outer cladding or insulation 50 of an electrical cable 52, while the other pair of crimp arms 20 are crimped onto conductors 54 of the cable.

Figure 6:
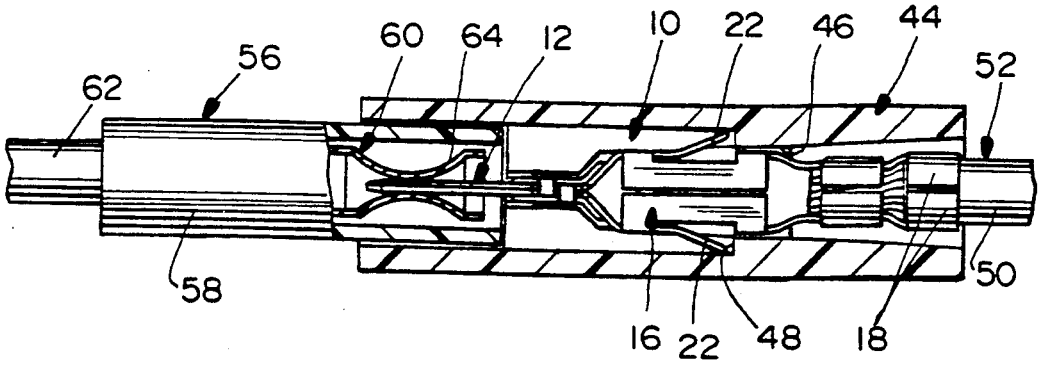
FIG. 6 is an elongated section similar to that of FIG. 5, with the connector and terminal mated to a complementary connector having a complementary female contact member.

FIG. 6 shows connector housing 44, with electrical terminal 10 mounted therein as described in relation to FIG. 5, mated with a complementary connector, generally designated 56. Although connector 56 does not comprise part of the invention, suffice it to say that the connector includes a dielectric housing 58 having a female contact member, generally designated 60, mounted therein. The female contact member is appropriately terminated to another electrical cable 62. Female contact member 60 includes a socket or female portion 64 which receives dual-thickness male contact blade 12 of terminal 10, the male contact blade incorporating the concepts of the invention, as described above.

Referring back to FIGS. 3 and 4, generally, it can be seen that blade portions 24 and 26 have different lengths. Specifically, blade portion 24 has a distal end 66 which extends beyond a distal end 68 of flat blade portion 26. Therefore, upon insertion of male contact blade 12 into the receptacle of complementary female contact member 60, as described above in relation to FIG. 6, distal ends 66 and 68 of blade portions 24 and 26, respectively, will sequentially engage the female contact member to reduce the insertion force of blade terminal 10 into female terminal 60.

Figure 3:
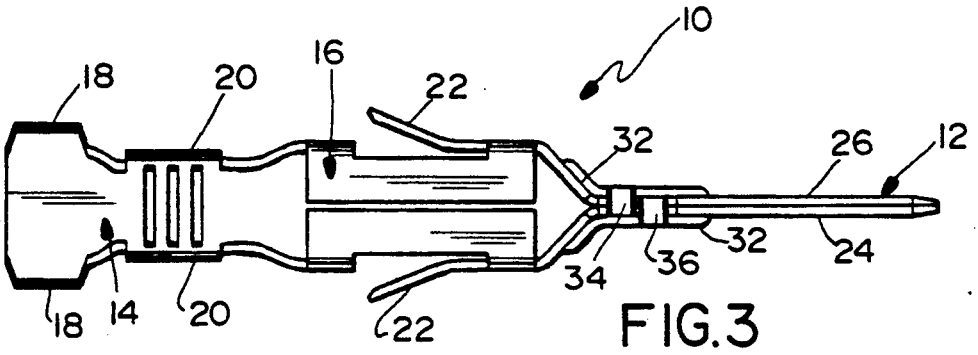
FIG. 3 is a top plan view of the terminal.
Figure 4:
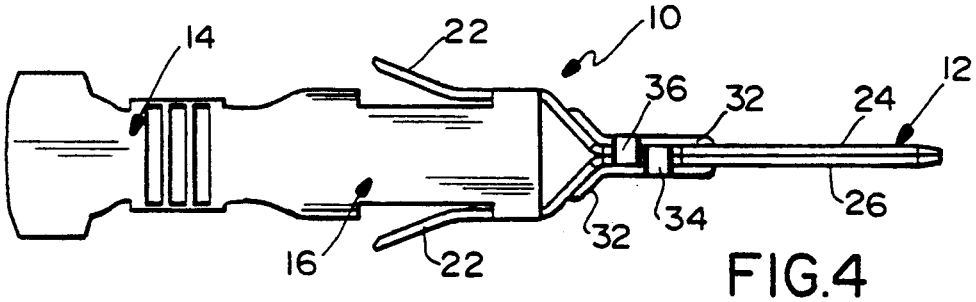
FIG. 4 is a bottom plan view of the terminal.
Figure 4A:
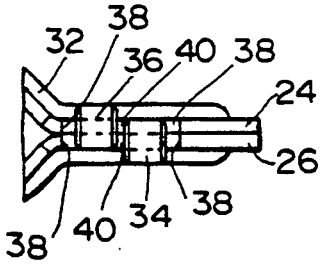
FIG. 4A is an enlarged, fragmented plan view of the tab area of the contact blade.
Figure 7:
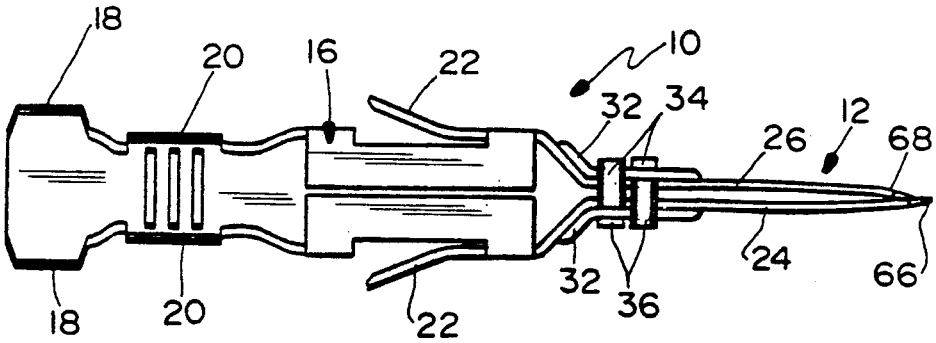
FIG. 7 is a top plan view of the terminal prior to the tabs being fully crimped, to illustrate the initial bowed orientation of the blade portions of the contact blade.

Lastly, FIG. 7 shows a feature of the invention wherein, during fabrication, blade portions 24 and 26 initially are formed in a bowed configuration whereby, upon initial crimping of tabs 34 and 36, distal ends 66 and 68 initially engage before the pair of flat blade portions are fully crimped into juxtaposition as shown in FIGS. 3 and 4. This initial bowed configuration of the blade portions prestress the blade portions to further facilitate holding the blade portions in juxtaposition along their entire length after tabs 34 and 36 are completely crimped from the condition shown in FIG. 7 to the condition shown in FIGS. 3 and 4.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a stamped and formed metal electrical terminal which includes a male contract blade at one end for being received in a complementary female contact member, a conductor terminating portion at an opposite end, and an intermediate section between the male contact blade and the conductor terminating portion, wherein the improvement comprises said male contact blade including a pair of juxtaposed flat blade portions each interconnected directly to the intermediate section by a respective connecting wall to establish direct electrical continuity between the blade portions and the intermediate section and, at least one tab extending from an edge of at least one flat blade portion and bent over the other flat blade portion to prevent the blade portions from separating.

2. In a stamped and formed metal electrical terminal as set forth in claim 1, wherein said flat portions have different lengths with a distal end of one blade portion extending beyond a distal end of the other blade portion whereby the distal ends are sequentially received in the complementary female contact member to reduce the insertion force of the terminal.

3. In a stamped and formed metal electrical terminal as set forth in claim 1, wherein said at least one flat blade portion includes a notch in said edge thereof, the tab extending from within the notch, and the other flat blade portion including a notch in an edge thereof and into which the tab is bent.

4. In a stamped and formed metal electrical terminal as set forth in claim 3, wherein said notches are only slightly wider, longitudinally of the terminal, than the tab to prevent the blade portions from sliding relative to each other.

5. In a stamped and formed metal electrical terminal as set forth in claim 3, wherein said notches are of respective depths at least equal to the thickness of the tab so that the tab does not project beyond the edges of the blade portions.

6. In a stamped and formed metal electrical terminal as set forth in claim 5, wherein said notches are only slightly wider, longitudinally of the terminal, than the tab to prevent the blade portions from sliding relative to each other.

7. In a stamped and formed metal electrical terminal which includes a male contact blade at one end for being received in a complementary female contact member, a conductor terminating portion at an opposite end, and an intermediate section between the male contact blade and the conductor terminating portion, wherein the improvement comprises said male contact blade including a pair of juxtaposed flat blade portions each having transversely aligned notches in adjacent edges thereof and being interconnected directly to the intermediate section by a respective connecting wall to establish direct electrical conductivity between the blade portions and the intermediate section and, including at least one tab extending from within the notch of at least one flat blade portion into the notch of the other flat blade portion and bent over an opposite side of the other flat blade portion to prevent the blade portions from separating, said notches being only slightly wider, longitudinally of the terminal, than the tab to prevent the blade portions from sliding relative to each other, and said notches being of respective depths at least equal to the thickness of the tab so that the tab does not project beyond the edges of the blade portions.

8. In a stamped and formed metal electrical terminal as set forth in claim 7, wherein said notches are provided in both opposite edges of both flat blade portions, with at least one of said tabs disposed at each opposite edge of the male contact blade within said notches.

9. In a stamped and formed metal electrical terminal as set forth in claim 7, including elongated reinforcing ribs stamped from the terminal and spanning a juncture between each flat blade portion and its respective connecting wall.

10. In a stamped and formed metal electrical terminal which includes a male contact blade at one end for being received in a complementary female contact member, a conductor terminating portion at an opposite end, and an intermediate section between the male contact blade and the conductor terminating portion, wherein the improvement comprises said male contact blade including a pair of juxtaposed flat blade portions each interconnected directly to the intermediate section by a respective connecting wall to establish direct electrical continuity between the blade portions and the intermediate section and, including at least one tab extending from opposite edges of said flat blade portions and bent over the respective opposite flat blade portion to prevent the blade portions from separating.

11. In a stamped and formed metal electrical terminal which includes a male contact blade at one end for being received in a complementary female contact member, and a conductor terminating portion at an opposite end of the terminal, wherein the improvement comprises said male contact blade including a pair of juxtaposed flat blade portions, and at least one tab extending from an edge of at least one flat blade portion and bent over the other flat blade portion to prevent the blade portions from separating.

12. In a stamped and formed metal electrical terminal as set forth in claim 11, wherein said flat blade portions include transversely aligned notches in adjacent edges thereof, and including at least one tab extending from within the notch of at least one flat blade portion into the notch of the other flat blade portion and bent over an opposite side of the other flat blade portion to prevent the blade portions from separating, said notches being only slightly wider, longitudinally of the terminal, than the tab to prevent the blade portions from sliding relative to each other, and said notches being of respective depths at least equal to the thickness of the tab so that the tab does not project beyond the edges of the blade portions.

13. In a stamped and formed metal electrical terminal as set forth in claim 11, wherein said at least one flat blade portion includes a notch in said edge thereof, the tab extending from within the notch, and the other flat blade portion including a notch in an edge thereof and into which the tab is bent.

14. In a stamped and formed metal electrical terminal as set forth in claim 13, wherein said notches are only slightly wider, longitudinally of the terminal, than the tab to prevent the blade portions from sliding relative to each other.

15. In a stamped and formed metal electrical terminal as set forth in claim 13, wherein said notches are of respective depths at least equal to the thickness of the tab so that the tab does not project beyond the edges of the blade portions.

16. In a stamped and formed metal electrical terminal as set forth in claim 15, wherein said notches are only slightly wider, longitudinally of the terminal, than the tab to prevent the blade portions from sliding relative to each other.

17. In a stamped and formed metal electrical terminal which includes a male contact blade at one end for being received in a complementary female contact member, and a conductor terminating portion at an opposite end of the terminal, wherein the improvement comprises said male contact blade including a pair of juxtaposed flat blade portions, the flat blade portions being in an initially mutually outwardly bowed configuration relative to each other, and including means for clamping the flat blade portions into flat juxtaposition against each other, whereby the initial bowed configuration prestresses the blade portions.

* * * * *